US011793338B1

(12) United States Patent
Beam

(10) Patent No.: US 11,793,338 B1
(45) Date of Patent: Oct. 24, 2023

(54) BEVERAGE CONTAINER HOLDER ASSEMBLY

(71) Applicant: Lisa M. Beam, Waynesville, NC (US)

(72) Inventor: Lisa M. Beam, Waynesville, NC (US)

( * ) Notice: Subject to any disclaimer, the term of this patent is extended or adjusted under 35 U.S.C. 154(b) by 0 days.

(21) Appl. No.: 17/237,702

(22) Filed: Apr. 22, 2021

Related U.S. Application Data

(60) Provisional application No. 63/015,122, filed on Apr. 24, 2020.

(51) Int. Cl.
*A47G 23/02* (2006.01)
*A47G 19/22* (2006.01)

(52) U.S. Cl.
CPC ..... *A47G 23/0216* (2013.01); *A47G 19/2227* (2013.01)

(58) Field of Classification Search
CPC .. A61J 9/06; A61J 9/0623; A61J 9/063; A61J 9/0653; A61J 9/0669; A61J 9/0676; A47G 23/02; A47G 23/0208; A47G 23/0216; A47G 23/0233; A47G 19/2266; A47G 19/2272; A47G 19/2227; B65D 81/3876; B65D 23/10; B65D 23/104; B65D 25/28; B65D 25/2835; B65D 25/2838; B65D 25/2841; B65D 25/2844; B65D 25/2852; B65D 25/2858; B65D 25/2861; B65D 25/2864
See application file for complete search history.

(56) References Cited

U.S. PATENT DOCUMENTS

| | | | | |
|---|---|---|---|---|
| 2,329,512 | A | 9/1943 | Clifford, Jr. | |
| 2,926,879 | A | 3/1960 | Dietrich | |
| 3,257,025 | A | 6/1966 | Jolly | |
| 3,360,957 | A | 1/1968 | Paquin | |
| 3,813,003 | A * | 5/1974 | Bernazzani | A47G 19/22 220/772 |
| 4,230,235 | A * | 10/1980 | Di Amico | B65D 25/2861 220/761 |
| 4,720,023 | A | 1/1988 | Jeff | |
| 5,040,719 | A | 8/1991 | Ballway | |
| 5,067,329 | A | 11/1991 | Tomliason | |
| 5,294,018 | A * | 3/1994 | Boucher | A47G 19/2272 215/388 |
| 6,398,061 | B2 | 6/2002 | Duff | |
| D663,164 | S * | 7/2012 | Taylor | D7/512 |

(Continued)

*Primary Examiner* — Don M Anderson
(74) *Attorney, Agent, or Firm* — Suzanne Kikel, Patent Agent

(57) ABSTRACT

A beverage container holder assembly for holding a fluid dispensing tumbler, and having a sleeve; mounting assemblies associated with the outer surface of the sleeve; two opposed handles movably attached to the mounting assemblies for movement relative to the outer surface of the sleeve; and a lid which is snapped onto the tumbler and having a plurality of fluid outlet ports and a rotatable center piece having a T-shaped configuration with three leg segments and a movable leg segment for selectively opening one of the plurality of fluid outlet ports and closing all of the ports. A first embodiment has spur gear assemblies associated with the movable handles and the sleeve; and a second embodiment has hinge assemblies associated the movable handles and the sleeve. The invention allows a user to grasp the beverage container holder assembly by the user's left or right hand or by both hands.

7 Claims, 6 Drawing Sheets

(56) References Cited

U.S. PATENT DOCUMENTS

| | | | | |
|---|---|---|---|---|
| D780,530 | S | 3/2017 | Seiders et al. | |
| 2004/0094552 | A1* | 5/2004 | Featherston | A47G 19/2272 220/259.3 |
| 2006/0213856 | A1 | 9/2006 | Kraus et al. | |
| 2010/0308047 | A1* | 12/2010 | Regan | A45F 3/18 220/212.5 |
| 2011/0139803 | A1* | 6/2011 | Leslie | A47G 23/0216 206/459.5 |
| 2015/0069075 | A1* | 3/2015 | Robbins, III | A47G 23/0216 220/737 |
| 2015/0108149 | A1* | 4/2015 | Baker | A47G 19/2266 220/375 |
| 2015/0114964 | A1* | 4/2015 | Vogel | B65D 43/0225 220/253 |
| 2017/0320643 | A1* | 11/2017 | Green | A47G 19/2272 |
| 2018/0008073 | A1* | 1/2018 | Goodnow | A47G 23/02 |
| 2019/0185211 | A1* | 6/2019 | Silsby | B65D 25/28 |
| 2020/0140180 | A1* | 5/2020 | Gray | B65D 81/3876 |
| 2020/0253406 | A1* | 8/2020 | Mills | A47G 23/0266 |

* cited by examiner

BEVERAGE CONTAINER HOLDER ASSEMBLY

CROSS REFERENCE TO RELATED APPLICATIONS

This application claims priority to U.S. Provisional Patent Application Ser. No. 63/015,122 filed Apr. 24, 2020, entitled "YOTA", the disclosure of which is incorporated herein by reference in its entirety.

BACKGROUND OF THE INVENTION

1. Field of the Invention

The present invention relates, in general, to a holder assembly for a beverage container, such as a fluid-dispensing tumbler or drinking cup, and more particularly, to a beverage container holder assembly with movable handles and which is adapted for use by people with manual disabilities.

2. Brief Description of the Prior Art

Many people with disabled hands, such as, crippling arthritic hands, often have trouble holding items, such as coffee cups or mugs, and therefore, may require a handle to hold such items. This may be the case of such a person attempting to hold a fluid-dispensing tumbler, such as those available in the market place being sold under the trade names of YETI®, ORCA®, TERVISs® or RTIC® tumblers. In general, these current day fluid-dispensing tumblers do not have handles for easy use by a person with disabled hands. Also, each time the user wants to change hands, he or she must remove the lid of the tumbler and re-position the lid in order to drink from the tumbler. Many times, this poses a difficult and onerous task.

There is, therefore, a need in the art to provide a beverage container holder assembly which has handles and which includes means for repositioning the handles thereof in order to make drinking from the fluid-dispensing tumbler easy for those people with disabled hands.

There is a further need in the art to provide a beverage container holder assembly with movable handles which may be repositioned and which includes a lid which can be easily positioned on the fluid-dispensing tumbler and which provides a fluid outlet port selectively positioned for easy access by the user depending on the positioning of the handles relative to the fluid-dispensing tumbler.

SUMMARY OF THE INVENTION

The present invention meets these needs. The present invention provides a beverage container holder assembly for carrying and supporting a liquid container, such as a fluid-dispensing tumbler, such as those presently available in the market place, such as those tumblers listed herein above. In the invention, a beverage container holder assembly, comprises a sleeve having a cylindrical side wall with an outer surface, an inner surface, a bottom rim, and a top rim; mounting assemblies associated with the outer surface of the sleeve; two opposed movable handles attached to the mounting assemblies for movement thereof relative to the outer surface of the sleeve; and a lid having a plurality of fluid outlet ports and a rotatable center piece for selectively opening one of the fluid outlet ports.

In a first embodiment, the mounting assemblies comprises at least two spaced-apart spur gear assemblies; and wherein each spur gear assembly has a first spur gear mounted on the outer surface of the sleeve and a second spur gear mounted in each of the two opposed handles for meshing engagement with the first spur gear on the outer surface of the sleeve. A first spur gear assembly is mounted near the top rim of the sleeve and a second spur gear assembly is mounted near the bottom rim of the sleeve.

The first spur gear mounted on the outer surface of the sleeve has a track assembly structured to retain the second spur gear of each of the two opposed handles in meshing engagement with the first spur gear on the outer surface of the sleeve. A plurality of U-shaped fingers, one of which is mounted on the upper and one on the lower portions of each of the two opposed handles for retaining each of the two opposed handles against the outer surface of the sleeve and in meshing engagement of the first spur gear mounted on the outer surface of the sleeve with the second spur gear mounted in each of the two opposed handles.

In the first embodiment of the invention, the movement of the two handles allows a desired positioning thereof such that the beverage container can be held by the user's right hand or by the user's left hand or by both hands. Furthermore, the beverage container holder assembly of the invention makes it easy and convenient to store the holder.

In a second embodiment of the invention, the mounting assemblies comprise a hinge assembly associated with each of the two opposed handles. The hinge assembly is located on an upper portion of each of the two opposed handles and on a lower portion of each of the two opposed handles, and each hinge assembly comprises a universal hinge mechanism. An elongated holder is mounted to and on the outer surface of the sleeve for retaining a straw.

The lid is structured to snap onto the fluid-dispensing tumbler carried and supported by the beverage container holder assembly, and the sleeve of both embodiments comprise a decorative logo in the form of a stylized "YOTA" on the outer surface of the sleeve.

These and other features and advantages of the present invention will be better appreciated and understood when the following description is read in light of the accompany drawings.

BRIEF DESCRIPTION OF THE DRAWINGS

The components in the figures are not necessarily to scale, emphasis instead being placed upon illustrating the principles of the invention. Moreover, in the figures, like reference numbers designate corresponding parts throughout the different views.

DETAILED DESCRIPTION OF THE INVENTION

Figure 1:
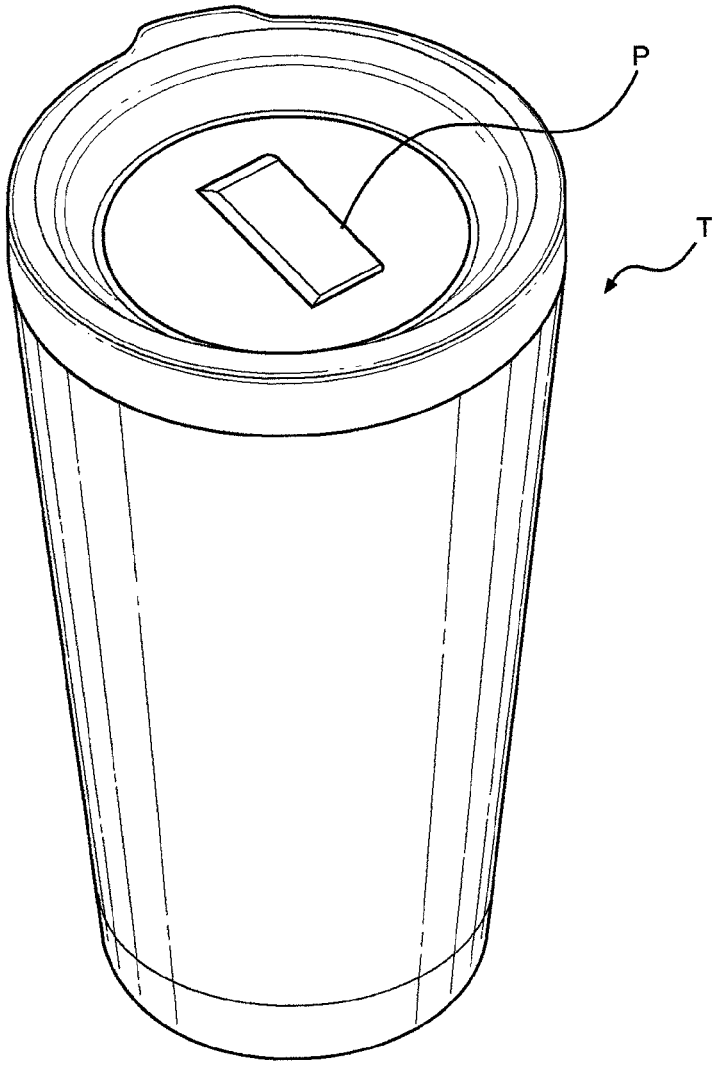
FIG. 1 (PRIOR ART)
FIG. 1 a perspective view of a typical fluid-dispensing tumbler of the prior art which may be carried by the beverage container holder assembly of the present invention.

Referring to the figures, the present invention pertains to a beverage container holder assembly comprising a cover lid and movable handles which may be held with either the right hand or the left hand or both hands of a user. An example of a fluid-dispensing tumbler T of the prior art which may be supported and carried by the beverage container holder assembly of the invention is shown in FIG. 1.

Figure 2:
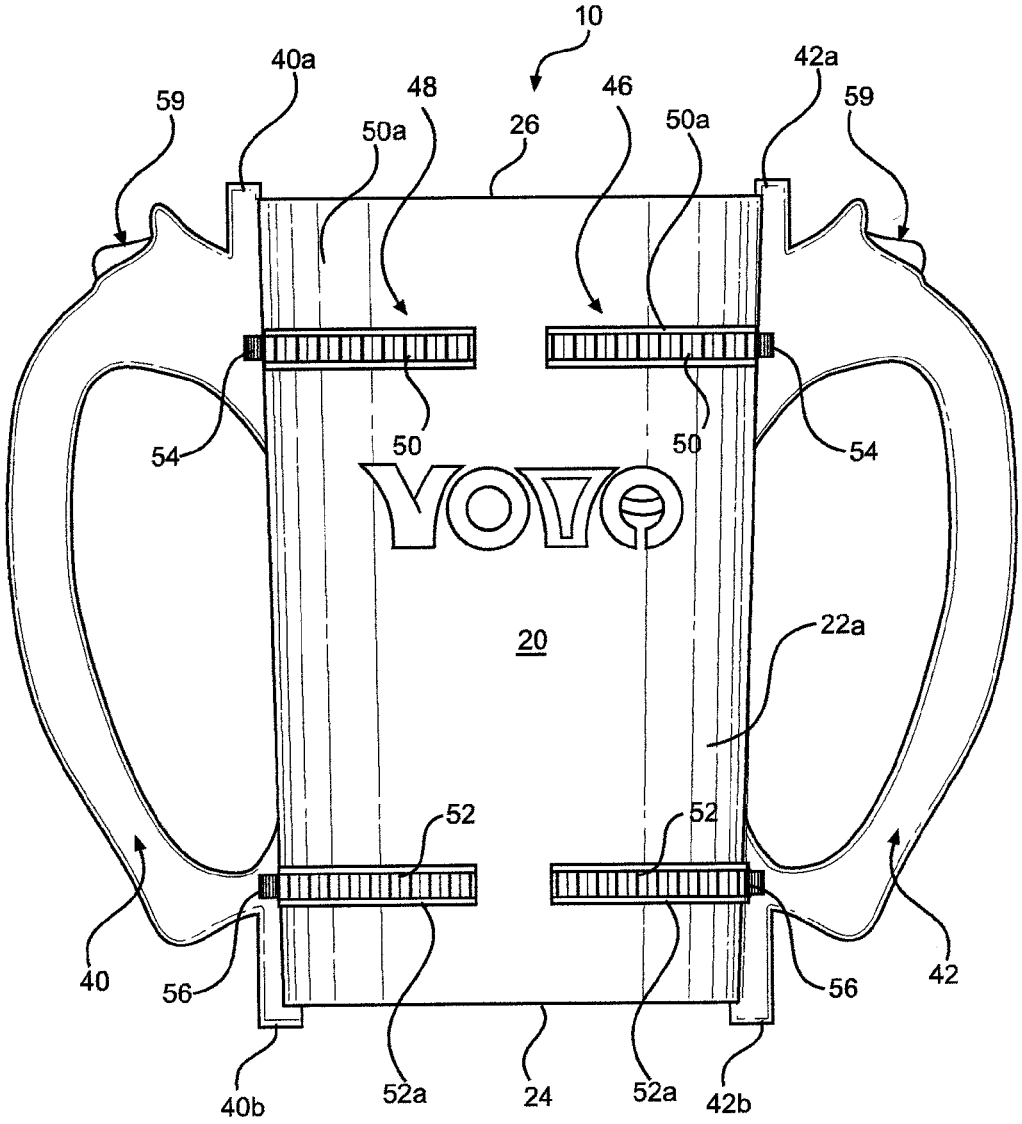
FIG. 2 is an elevational view of a beverage container holder assembly of a first embodiment of the invention with movable handles via spur gear assemblies.
Figure 4:
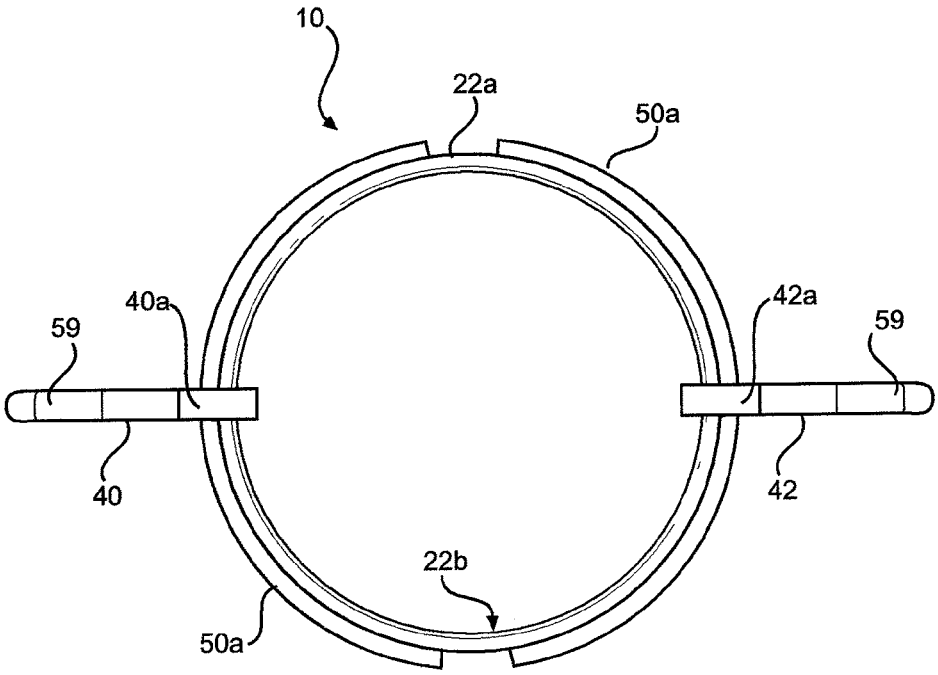
FIG. 4 is a top plan view of the beverage container holder assembly of FIG. 2.

A first embodiment of a beverage container holder assembly 10 of the invention is illustrated in FIGS. 2 and 4. Beverage container holder assembly 10 is in the form of a sleeve and is designed to hold and support a fluid-dispensing tumbler T of FIG. 1 or other similar fluid-dispensing tumblers, such as those discussed hereinabove and presently available in the market place, in such a manner that allows a person with disabled hands, such as arthritic hands, to use either his/her right hand or his/her left hand, as necessary.

Beverage container holder assembly 10 comprises a sleeve 20 which is in the form of a cylindrical housing. Sleeve 20 has a sidewall 22 with an outer surface 22*a* (FIG. 2) and an inner cylindrical surface 22*b* (FIG. 4). Sidewall 22 forms a bottom rim 24 and a top rim 26 for sleeve 20. Sleeve 20 is structured such as to allow the fluid-dispensing tumbler T of FIG. 1 to be snugly inserted therein and to be substantially carried and supported by sleeve 20. Referring particularly to FIG. 2, beverage container holder assembly 10 further comprises two opposed handles 40 and 42 which are movably mounted on the outer surface 22*a* of sidewall 22 of sleeve 20. Handles 40, 42 are structured to be manually moved around the outer surface 22*a* of sleeve 20 in a circumferential direction, whereby the user of beverage container holder assembly 10 can selectively move handles 40, 42 in a desired location which is most comfortable for the user. Also, handles 40, 42 can be selectively moved toward each other in a non-use or in a storage positioning for storing beverage container holder assembly 10.

Referring again to FIG. 2, beverage container holder assembly 10 further comprises two spur gear assemblies 46, 48. Each spur gear assembly 46, 48 comprises two spaced-apart first spur gears 50, 52 which circumferentially wrap around a portion of the outer surface 22*a* of sidewall 22. Spaced-apart first spur gears 50, 52 are fixedly mounted to sidewall 22 through suitable means, such as an adhesive, as for example, glue and/or fasteners, such as, for example, pins. Still referring to FIG. 2, first spur gears 50 are mounted in an upper area and near the top rim 26 of sleeve 20; and first spur gears 52 are mounted in a lower area and near the bottom rim 24 of sleeve 20. Also, as stated herein above, the two spaced-apart first spur gears 50, 52 of each spur gear assembly 46, 48 extend partially around the circumference of sidewall 22 of sleeve 20.

Still referring to FIG. 2, each spur gear assembly 46, 48 further comprises second spur gears 54, 56. Each second spur gear 54, 56 is rotatably mounted through suitable means in each handle 40, 42. That is, and with reference to the right of FIG. 2, second spur gear 54 is rotatably mounted through suitable means in the upper portion of handle 42 and second spur gear 56 is rotatably mounted through suitable means in the lower portion of handle 42. Likewise, and with reference to the left of FIG. 2, second spur gear 54 is rotatably mounted through suitable means in the upper portion of handle 40 and second spur gear 56 is rotatably mounted through suitable means in the lower portion of handle 40. Suitable means for fixedly mounting and rotating second spur gears 54, 56 in handles 40, 42 may, for example, include a rotatable pin, which are available in the marketplace and well known to those skilled in the art. The meshing of second spur gears 54, 56 with an upper first spur gear 50 and a lower first spur gear 52 is well-known to those skilled in the art.

Spur gear assemblies 46, 48 have a constant speed ratio and a parallel axis. In order to prevent second spur gears 54 in handles 40, 42 from slipping out of meshing engagement with first spur gears 50, first spur gears 50 are retained in a tracking system 50*a*. It is to be appreciated that tracking system 50*a* has outwardly extended spaced-apart walls for retaining spur gears 54 therein while handles 40, 42 are being moved along first spur gears 50. Tracking system 50*a* also has a vertical wall for stopping movement of spur gears 54, and therefore, handles 40, 42 along sidewall 22 of sleeve 20. Likewise, so as to prevent second spur gears 56 in handles 40, 42 from slipping out of meshing engagement with spur gears 52, first spur gears 52 are retained in a tracking system 52*a*. Tracking system 52*a* has outwardly extended spaced-apart walls for retaining second spur gears 56 therein while handles 40, 42 are being moved along first spur gears 52. Tracking system 52*a* also has a vertical wall for stopping movement of spur gears 56, and therefore, handles 40, 42 along sidewall 22 of sleeve 20. From the above, it is apparent that second spur gears 54, 56 are retained in a tracking system 50*a*, 52*a*, respectively, while handles 40, 42 are being moved circumferentially around the outer surface 22*a* of sleeve 20.

Still referring to FIG. 2, handles 40, 42 also have thumb rests 59 which are shaped in a decorative configuration. Also, in order to ensure that handles 40, 42 are retained against sidewall 20 of sleeve 20, a finger 40*a* is provided on the upper portion of handle 40 and a finger 40*b* is provided on the lower portion of handle 40. Similarly, a finger 42*a* is provided on the upper portion of handle 40 and a finger 42*b* is provided on the lower portion of handle 42. These fingers 40*a*, 40*b*, 42*a* and 42 *b* are U-shaped.

As best shown in FIG. 4, U-shaped finger 40*a* of handle 40 and U-shaped finger 42*a* of handle 42 extend out over the top rim 26 and down into and against the inner surface of 22*b* of sleeve 20. Even though not shown, U-shaped finger 40*b* of handle 40 and U-shaped finger 42*b* of handle 42 extend out over the lower rim 24 and up into and against the inner surface 22*b* of sleeve 20 in a similar manner. As stated herein above, this arrangement of U-shaped fingers 40*a*, 42*a*, 40*b*, and 42*b* of handles 40, 42 helps to ensure that handles 40, 42 remain in an abutting relationship with sleeve 20 such that second spur gears 54, 56 of handles 40, 42 remain in meshing engagement with first spur gears 50, 52 on sidewall 22 of sleeve 20. That is, since each handle 40, 42 is securely attached to sleeve 20 for movement around sleeve 20, second spur gears 54, 56 remain in meshing engagement with first spur gears 50, 52 of sleeve 20 of beverage container holder assembly 10.

The structure of these U-shaped fingers or hooks are such that they engage the top rim 26 and the bottom rim 24 of sleeve 20 so that movable handles 40, 42 can be retained on sleeve 20 while handles 40, 42 are in a stationary positioning or when handles 40, 42 are being manually rotated around sleeve 20 for a desired positioning thereof. It is to be appreciated that instead of or in addition to U-shaped fingers 40*a*, 42*a*, 40*b*, and 42*b*, other well-known devices may be employed in this embodiment of the invention to retain handles 40, 42 in contact with and against sleeve 20.

Figure 5:
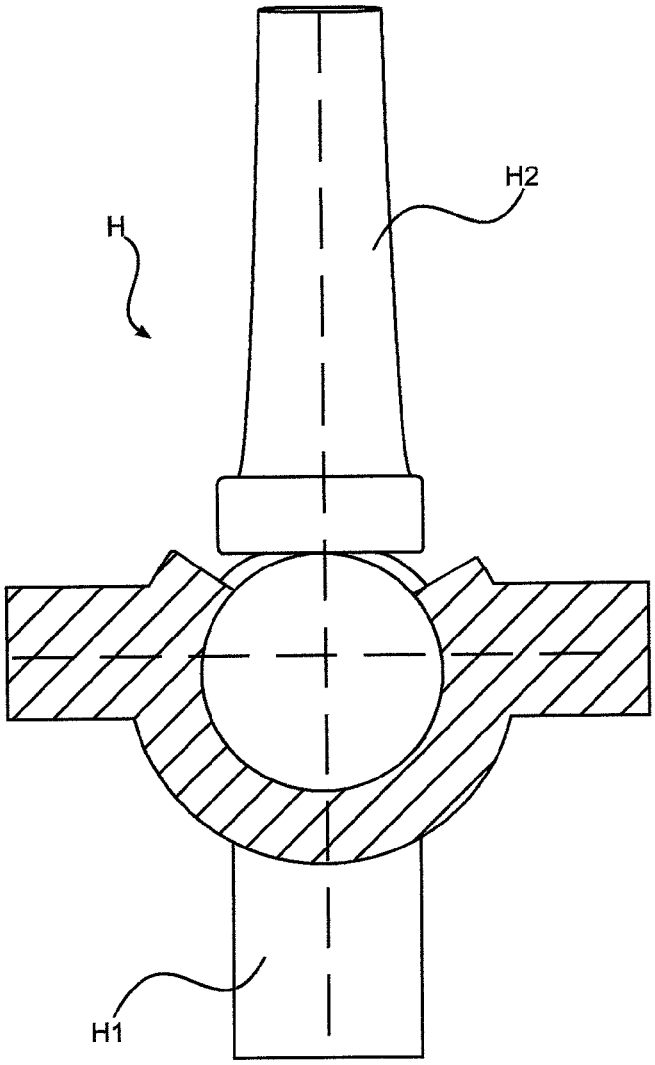
FIG. 5 is an enlarged, partly cross-sectional view of a universal hinge assembly for mounting the movable handles of the beverage container holder assembly of a second embodiment of the invention.
Figure 6:
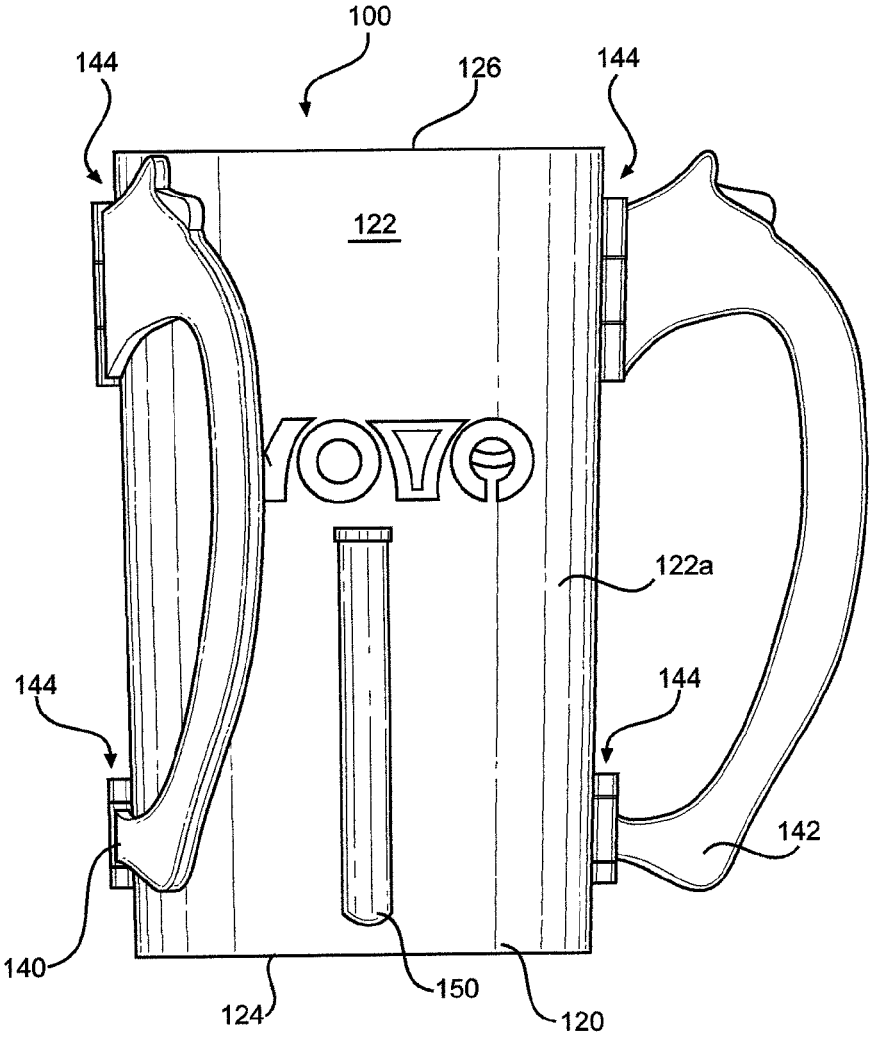
FIG. 6 is an elevational view of the beverage container holder assembly of a second embodiment of the invention employing the universal hinge assembly of FIG. 5.
Figure 7:
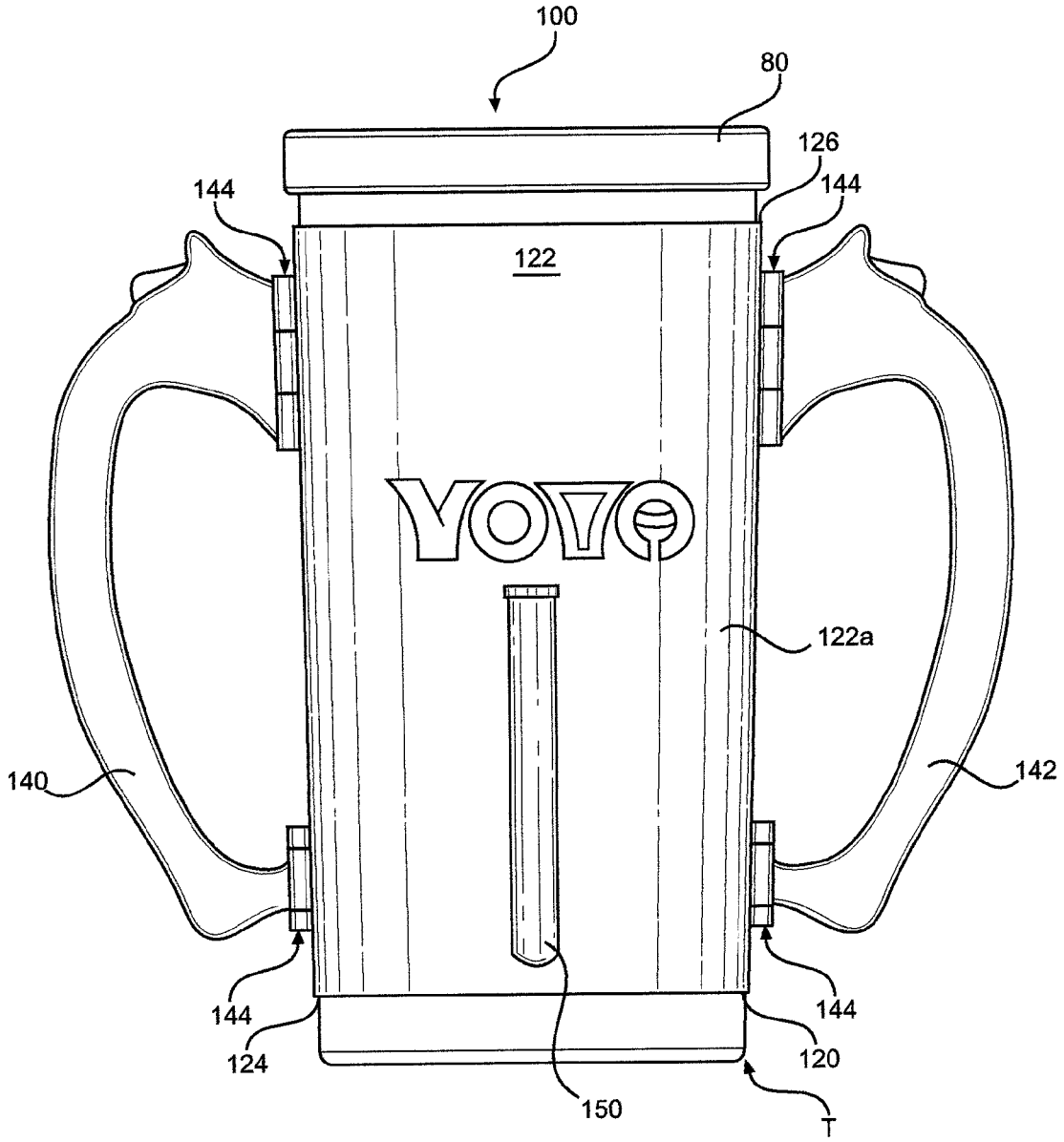
FIG. 7 is an elevational view of the beverage container holder assembly of FIG. 6 which is carrying and supporting a fluid-dispensing tumbler of the prior art of FIG. 1.

FIGS. 5, 6 and 7 disclose a second embodiment of the invention. With particular reference to FIGS. 6 and 7, a beverage container holder assembly 100. Beverage container holder assembly 100 comprises a sleeve 120 which is in the form of a cylindrical housing. Sleeve 120 has a sidewall 122 with an outer surface 122*a* and an inner surface (not shown). Sidewall 122 forms a bottom rim 124 and a top rim 126 for sleeve 120. Sleeve 120 is structured such as to allow the fluid-dispensing tumbler T of FIG. 1 to be snugly inserted therein and to be substantially carried and supported by sleeve 120. Referring particularly to FIGS. 6 and 7, beverage container holder assembly 100 further comprises two opposed handles 140 and 142 which are movably mounted on the outer cylindrical surface 122*a* of sidewall 122 of sleeve 120.

With particular reference to FIGS. 6 and 7, handles 140, 142 are constructed to be pivotally moved relative to the outer cylindrical surface 122*a* of sidewall 122 of cylindrical housing 120. Such pivotal movement is best shown in FIG. 6 with respect to handle 140. Pivotal movement of handles 140, 142 is via a hinge assembly 144 provided in the upper and lower portion of each handle 140, 142. Each hinge assembly 144 is comprised of a universal hinge mechanism H as shown in FIG. 5. Universal hinge mechanism H includes a first hinge element H1 and a second hinge element H2. Attachment of the hinge mechanism H in each hinge assembly 144 is in a manner well-known to those skilled in the art, and hinge mechanism H is readily available in the marketplace. In general, and in pivotal movement of handles 140, 142, the two outermost segments of each hinge assembly 144 will remain in a fixed position on the outer surface 122*a* of sidewall 122 and the innermost segment of each hinge assembly 144 will pivot with handles 140, 142. This second embodiment of the invention may not permit the circumferential re-positioning of the handles 40, 42; but the hinge assembly H does permit handles 40, 42 to be folded against the sidewall 122 of sleeve 120 for convenient storage of beverage container holder assembly 100.

Figure 3:
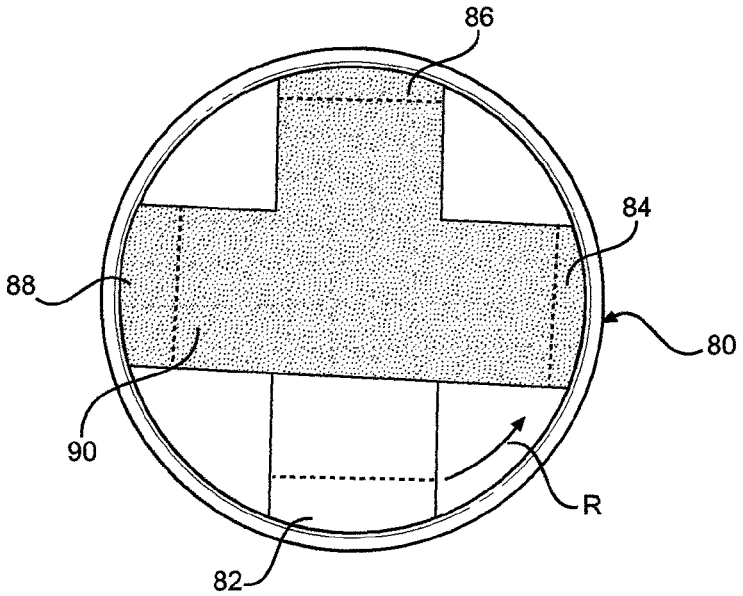
FIG. 3 is a top plan view of a lid which is a component of the beverage container holder assembly of the invention.

Referring to FIG. 3, both beverage container holder assembly 10, 100 further comprise a lid 80. As best shown in FIG. 7, lid 80 fits down over the top rim tumbler T of FIG. 1. Lid 80 has fluid outlet ports 82, 84, 86, and 88 which are shown in FIG. 3 as being equally spaced around the outer periphery of lid 80. Still referring to FIG. 3, lid 80 further comprises a center piece 90. Center piece 90 is constructed to snap into and rotate within lid 80. Center piece 90 is in a T-shape configuration forming three leg segments which are oriented so as to close three of the four fluid outlet ports 82, 84, 86 and 88 depending on the positioning of center piece 90 within lid 80. For example, if handles 40, 42 of FIG. 4 are in the positioning shown therein, then center piece 90 would be rotated such that the fluid outlet port 82 would be opened to allow fluid from tumbler T to be dispensed to the user and fluid outlet ports 84, 86, and 88 would be closed by each of the three leg segments of center piece 90.

As stated herein above, center piece 80 is rotationally mounted in cover lid 60 and is rotated into a desired position as indicated by an arrow R. Center piece 90 of lid 80 also contains a movable leg segment (not shown) which would be associated with the fluid outlet port 82-88 which would remain open as a result of the rotation of center piece 80. This movable leg segment would be about the same size of fluid outlet ports 82-88; would be either slidable or hinged in which instance it would snap down onto the outer surface of lid 80 through suitable means well-known to those skilled in the art. That is, each fluid outlet port 82-88 would have a projection associated near its opening which would allow the movable leg segment (not shown) to be stopped or snapped down onto the lid 80 for closing off of all fluid outlet ports. That is, the three leg segments of center piece 90 and the closing of the movable leg segment would result in all fluid outlet ports 82-88 being closed when beverage container holder assembly 10, 100 is not in use.

Beverage container holder assembly 10, 100 may further comprise a decorative logo, such as, for example, "YOTA" which is in a stylized form in FIGS. 2, 6 and 7.

As can be understood from FIG. 1, tumbler T has a cover C with a fluid outlet port P through which fluid exits the tumbler T for consumption. When using the beverage container holder assembly 10, 100 of the invention, tumbler T is inserted therein, and cover C of tumbler T is preferably removed and replaced by lid 80 of FIG. 3. Fluid will exit tumbler T through an uncovered outlet port 82-88 depending on the positioning of center piece 90 within lid 80 as the tumbler T is tipped by the user holding beverage container holder assembly 10, 100.

In using the beverage container holder assembly 10, a tumbler T containing a liquid, is placed inside beverage container holder assembly 10. Preferably, the cover C of tumbler T is removed and replaced by lid 80 of the invention. Center piece 90 of lid 80 is oriented so that the three legs of center piece 90 cover the non-selected outlet ports 82-88. The user moves handles 40, 42 into a desired position and then grasps either or both handles 40, 42 and tips the beverage container holder 10 to dispense fluid from the tumbler T to the user via one of the selected outlet ports 82-88. When not in use, the movable leg (not shown) of center piece 90 of lid 80 is then operated to close the one outlet port 82-88 which is not covered by the three legs of center piece 90.

If the user desires to change hands, beverage container holder assembly 10 easily accommodates this desired change by the user simply rotating center piece 90 so that the appropriate fluid outlet port 82-88 is opened. It is apparent that lid 80 may be more readily used with the beverage container holder assembly 10 since handles 40, 42 are movable around the outer cylindrical surface 22*a* of sidewall 22 of sleeve 20 and it is important that an appropriate outlet port 82-88 be readily available to the user, such as that shown in FIG. 3. Also, in some situations, it may be more desirable to first move the handles 40, 42 into a desired positioning around the sidewall 22 of sleeve 20 and then insert the tumbler T into sleeve 20 of beverage container holder assembly 10.

Referring again to FIGS. 6 and 7, beverage container holder assembly 100 further comprises an elongated sleeve 150 on the front of sidewall 122, which may be used for receiving and carrying a straw (not-shown) for use with tumbler T.

While the present invention has been described in connection with a preferred embodiment of the figures, it is to be understood that other similar embodiments may be used or modifications and additions may be made to the described embodiment for performing the same function of the present invention without deviating therefrom. Accordingly, it is intended by the appended claims to cover all such changes and modifications as come within the spirit and scope of the invention.

What is claimed is:

1. A beverage container holder assembly for carrying and supporting a fluid-dispensing tumbler, comprising:

a sleeve having a cylindrical side wall with an outer surface, an inner surface, a bottom rim and a top rim;

at least two pivotal handles located diametrically opposite each other on the outer surface of the cylindrical side wall of the sleeve;

a first hinge assembly located on an upper portion of each of the two pivotal handles and a second hinge assembly located on a lower portion of each of the two pivotal handles for pivotal movement of each of the two pivotal handles relative to the outer surface of the cylindrical side wall of the sleeve; and a lid having at least four fluid outlet ports being equally spaced around the outer periphery of the lid, and a rotatable center piece for selectively opening one of the at least four fluid outlet ports and comprising a T-configuration with three leg segments and a movable leg segment.

2. The beverage container holder assembly of claim 1, wherein the movable leg segment of the center piece comprises a hinged member.

3. The beverage container holder assembly of claim 1, wherein the movable leg segment of the center piece comprises a slidable member.

4. The beverage container holder assembly of claim 1, wherein the sleeve further comprises a decorative logo in the form of a stylized "YOTA" on the outer surface of the sleeve.

5. The beverage container holder assembly of claim 1, wherein the lid is structured to snap onto the fluid-dispensing tumbler carried and supported by the beverage container holder assembly.

6. The beverage container holder assembly of claim 1, further comprising an elongated holder on the outer surface of the sleeve for retaining a straw.

7. The beverage container holder assembly of claim 1, wherein the first hinge assembly comprises a first hinge element and a second hinge element, and wherein the second hinge assembly comprises a first hinge element and a second hinge element.

* * * * *